US010844450B2

(12) United States Patent
Goto

(10) Patent No.: US 10,844,450 B2
(45) Date of Patent: Nov. 24, 2020

(54) BLACK HEART MALLEABLE CAST IRON AND MANUFACTURING METHOD THEREOF

(71) Applicant: Hitachi Metals, Ltd., Tokyo (JP)

(72) Inventor: Ryo Goto, Kuwana (JP)

(73) Assignee: Hitachi Metals, Ltd., Tokyo (JP)

( * ) Notice: Subject to any disclaimer, the term of this patent is extended or adjusted under 35 U.S.C. 154(b) by 150 days.

(21) Appl. No.: 15/578,511

(22) PCT Filed: Jun. 2, 2016

(86) PCT No.: PCT/JP2016/002670

§ 371 (c)(1),
(2) Date: Nov. 30, 2017

(87) PCT Pub. No.: WO2016/194377

PCT Pub. Date: Dec. 8, 2016

(65) Prior Publication Data

US 2018/0163281 A1 Jun. 14, 2018

(30) Foreign Application Priority Data

Jun. 2, 2015 (JP) ..... 2015-112049

(51) Int. Cl.

| | |
|---|---|
| ***C21D 5/14*** | (2006.01) |
| ***C22C 37/10*** | (2006.01) |
| ***C22C 1/02*** | (2006.01) |

(52) U.S. Cl.
CPC ..... *C21D 5/14* (2013.01); *C22C 1/02* (2013.01); *C22C 37/10* (2013.01)

(58) Field of Classification Search
CPC ..... C21D 5/14; C22C 1/02; C22C 37/10
See application file for complete search history.

(56) References Cited

U.S. PATENT DOCUMENTS

| | | | | |
|---|---|---|---|---|
| 1,984,474 | A * | 12/1934 | Good | C22C 37/10 148/322 |
| 2,501,059 | A * | 3/1950 | Kluijtmans | C22C 37/10 148/545 |
| 2003/0007882 | A1 | 1/2003 | Perrin et al. | |
| 2009/0297386 | A1 | 12/2009 | Takahashi et al. | |

FOREIGN PATENT DOCUMENTS

| | | | |
|---|---|---|---|
| CN | 85106684 | A | 3/1987 |
| CN | 87105171 | A | 5/1988 |
| CN | 1219601 | A | 6/1999 |
| EP | 0 653 495 | A1 | 5/1995 |
| JP | 31-7814 | B1 | 9/1956 |
| JP | 49-94514 | A | 9/1974 |
| JP | 56-22924 | B2 | 5/1981 |
| JP | 07-138636 | A | 5/1995 |
| JP | 2002-348634 | A | 12/2002 |
| JP | 2008-223135 | A | 9/2008 |
| JP | 2008-285711 | A | 11/2008 |
| JP | 2014-148694 | A | 8/2014 |

OTHER PUBLICATIONS

The Effect of Aluminium on Graphitization of Cast Iron Treated with Cerium Mixture M. S. Soiński , A. Jakubus, P. Kordas, K. Skurka Archives of Foundry Engineering vol. 14, Issue 2/2014, 95-100 (Year: 2014).*

Li Shanhai, "Experimental research and production of high silicon bismuth-containing black heart malleable cast iron", *Foundry*, No. 1, Jan. 31, 1965, pp. 2-6.

The First Office Action dated Mar. 1, 2019, of counterpart Chinese Application No. 201680031481.X, along with an English translation.

* cited by examiner

*Primary Examiner* — Jenny R Wu

(74) *Attorney, Agent, or Firm* — DLA Piper LLP (US)

(57) ABSTRACT

A black heart malleable cast iron including carbon of not lower than 2.0% and not higher than 3.4%; silicon of not lower than 0% and not higher than 1.4%; aluminum of not lower than 2.0% and not higher than 6.0%, which are all expressed by percent by mass; and balance iron and inevitable impurities, wherein a value of a carbon equivalent CE expressed by Equation (1) is not lower than 3.0% and not higher than 4.2%, where C denotes a content of the carbon expressed by percent by mass, Si denotes a content of the silicon expressed by percent by mass and Al denotes a content of the aluminum expressed by percent by mass: CE=C+Si/3+Al/8 (1).

7 Claims, 6 Drawing Sheets

BLACK HEART MALLEABLE CAST IRON AND MANUFACTURING METHOD THEREOF

TECHNICAL FIELD

This disclosure relates to a black heart malleable cast iron having improved mechanical strength, improved high temperature oxidation resistance and improved vibration damping performance, and a manufacturing method of the same.

BACKGROUND

Cast irons are classified into, for example, flake graphite cast iron, spheroidal graphite cast iron and black heart malleable cast iron according to the existence form of carbon.

Flake graphite cast iron is also called gray cast iron and has such a form that flake graphite is distributed in a pearlite matrix. Flake graphite cast iron has low mechanical strength, but excellent vibration damping performance. Accordingly, flake graphite cast iron is widely used, for example, for general applications that do not require the high mechanical strength and machine tools that require vibration damping performance.

Spheroidal graphite cast iron is also called ductile cast iron and has such a form that spheroidal graphite is distributed in a pearlite matrix. Spheroidal graphite cast iron has better mechanical strength, but lower vibration damping performance compared to flake graphite cast iron.

Black heart malleable cast iron is also called malleable cast iron and has such a form that lump graphite is distributed in a ferrite matrix. Black heart malleable cast iron has better mechanical strength compared to flake graphite cast iron and also has high toughness owing to the ferrite matrix. Accordingly, black heart malleable cast iron is widely used, for example, for automobile components and pipe joints that require the high mechanical strength and high toughness.

In flake graphite cast iron and spheroidal graphite cast iron, the final distribution form of graphite is determined in the as-cast state. In black heart malleable cast iron, on the other hand, as described in, for example, JP 2008-285711 A, carbon is present not in the form of graphite, but in the form of cementite ($Fe_3C$) in an intermediate product in the as-cast state. The process of annealing the intermediate product to a temperature of higher than 720° C. by reheating decomposes cementite and causes lump graphite to precipitate.

Black heart malleable cast iron actually has better mechanical strength compared to flake graphite cast iron, but tends to have lower mechanical strength compared to spheroidal graphite cast iron, steel material, cast steel and the like. Black heart malleable cast iron may thus not be usable for applications that require extremely high mechanical strength. Not only black heart malleable cast iron, but any cast iron is an iron-based material and thus tends to react with oxygen and accelerate oxidation on the surface in a high temperature range. Cast iron may thus be not usable for applications that require high temperature oxidation resistance. Ni-resist cast iron with addition of nickel for the purpose of improving the high temperature oxidation resistance has been in practical use. Nickel is, however, expensive so that using nickel undesirably increases the manufacturing cost.

By taking into account the above problems, some attempts have been made to improve the properties such as mechanical strength and high temperature oxidation resistance by adding less expensive aluminum than nickel to the cast iron. For example, JP 2002-348634 A and JP 2008-223135 A describe that adding aluminum to flake graphite cast iron enhances the rigidity (Young's modulus) and vibration damping performance. In another example, JP 2014-148694 A describes that spheroidal graphite cast iron with addition of aluminum has excellent high temperature oxidation resistance and excellent toughness. Accordingly, as in flake graphite cast iron and spheroidal graphite cast iron with addition of aluminum, enabling aluminum to be added to the black heart malleable cast iron is expected to improve the properties, i.e., mechanical strength, high temperature oxidation resistance and vibration damping performance.

Adding aluminum to black heart malleable cast iron, however, causes problems described below. First, aluminum is an element that accelerates graphitization so that flake graphite called "mottle" is crystallized when a molten metal of black heart malleable cast iron with addition of aluminum is poured into a mold (hereinafter expressed as "in the course of casting"). This flake graphite is a stable phase and accordingly does not disappear by annealing, but remains in the matrix. The coexistence of lump graphite precipitating by annealing and flake graphite crystallized in the pouring process reduces the mechanical strength of the black heart malleable cast iron to a level equivalent to that of flake graphite cast iron.

Second, aluminum is an element that is likely to form an Fe—Al composite carbide (κ phase) in the matrix. When the Fe—Al composite carbide is formed, part of aluminum added is consumed for crystallization of the Fe—Al composite carbide. It takes a long time to decompose the formed Fe—Al composite carbide at a conventional annealing temperature. This reduces the concentration of aluminum dissolved in a ferrite (α phase) matrix and thereby fails to sufficiently improve the high temperature oxidation resistance of the black heart malleable cast iron. Because of the above problems, it is difficult to add aluminum to black heart malleable cast iron.

It could therefore be helpful to provide black heart malleable cast iron that does not cause crystallization of flake graphite in the as-cast state and causes a sufficient amount of aluminum to improve the high temperature oxidation resistance to be dissolved in a ferrite matrix after annealing, and a manufacturing method of the same.

SUMMARY

We thus provide:

A black heart malleable cast iron containing carbon, silicon, aluminum, and balance iron and inevitable impurity. This black heart malleable cast iron does not cause crystallization of flake graphite in the as-cast state and improves the high temperature oxidation resistance in the ferrite matrix after annealing. Preferably, the black heart malleable cast iron contains carbon of not lower than 2.0% and not higher than 3.4%; silicon of not lower than 0% and not higher than 1.4%; and aluminum of not lower than 2.0% and not higher than 6.0%, which are all expressed by percent by mass and has value of a carbon equivalent CE expressed by Equation (1) of not lower than 3.0% and not higher than 4.2%, where C denotes a content of carbon expressed by percent by mass, Si denotes a content of silicon expressed by percent by mass and Al denotes a content of aluminum expressed by percent by mass:

$$CE=C+Si/3+Al/8 \quad (1).$$

Setting the contents of carbon, aluminum and silicon and the value of the carbon equivalent CE in the above ranges suppresses crystallization of flake graphite in the course of casting. Even annealing at the same temperature as the conventional annealing temperature enables an Fe—Al composite carbide to be decomposed in a short time period. Aluminum is dissolved in the ferrite matrix.

Preferably, the content of silicon contained in the black heart malleable cast iron is not lower than 0% and not higher than 0.5%. Silicon is an element that accelerates graphitization so that the smaller content of silicon preferably further suppresses crystallization of flake graphite. Preferably, the content of aluminum contained in the black heart malleable cast iron is not lower than 4.0% and not higher than 6.0%.

A manufacturing method of a black heart malleable cast iron comprises preparing a molten metal by melting a raw material that is blended to contain carbon, silicon, aluminum and balance iron and inevitable impurity; pouring the molten metal into a mold to cast a chilled cast product; and annealing the cast product to a temperature of higher than 720° C. by reheating. Preferably, the molten metal is prepared by melting the raw material that contains carbon of not lower than 2.0% and not higher than 3.4%, silicon of not lower than 0% and not higher than 1.4% and aluminum of not lower than 2.0% and not higher than 6.0%, which are all expressed by percent by mass, and that is blended such that value of a carbon equivalent CE expressed by Equation (1) is not lower than 3.0% and not higher than 4.2%, where C denotes a content of carbon expressed by percent by mass, Si denotes a content of silicon expressed by percent by mass and Al denotes a content of aluminum expressed by percent by mass:

$$CE=C+Si/3+Al/8 \quad (1).$$

We can thus suppress crystallization of flake graphite in the casting process even when the composition contains aluminum and enables aluminum to be dissolved in a ferrite matrix in the annealing process. This provides a black heart malleable cast iron having improved mechanical strength, improved high temperature oxidation resistance and improved vibration damping performance compared to conventional black heart malleable cast iron.

DETAILED DESCRIPTION

Figure 1:
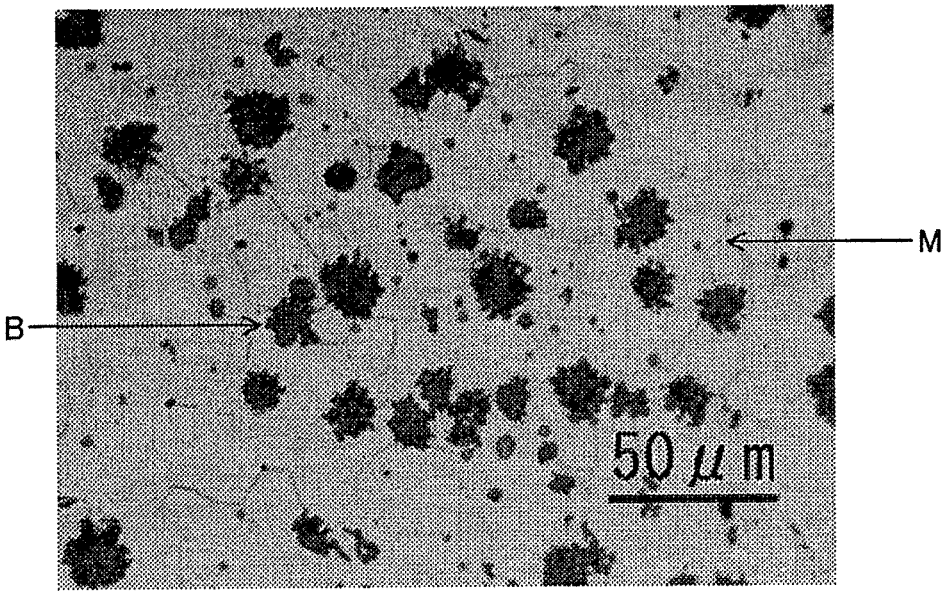
FIG. 1 is an optical micrograph of a sample of Example 2.

Examples are described in detail below with reference to the drawings and tables. The examples described hereinafter are only illustrative, and aspects of this disclosure are not limited to the examples described hereinafter.

Composition

The following describes the composition of a black heart malleable cast iron according to an example. In the description hereof, the content of each element and a carbon equivalent CE are all expressed by percent by mass.

The black heart malleable cast iron contains carbon of not lower than 2.0% and not higher than 3.4%. When the content of carbon is lower than 2.0%, the melting point of a molten metal used to cast the black heart malleable cast iron exceeds 1400° C. As a result, the raw material needs to be heated to high temperature for the purpose of manufacturing the molten metal, and large-scale equipment is required. At the same time, this increases the viscosity of the molten metal. The molten metal is thus unlikely to flow, and there is a difficulty in pouring the molten metal into a casting mold. Accordingly, the lower limit value of the content of carbon is set to 2.0%. When the content of carbon is higher than 3.4%, flake graphite is likely to precipitate in the course of casting. Accordingly, the upper limit value of the content of carbon is set to 3.4%. The lower limit value of the content of carbon is preferably 2.5%. The upper limit value of the content of carbon is, on the other hand, preferably 3.0%.

The black heart malleable cast iron according to the example contains silicon of not lower than 0% and not higher than 1.4%. When the content of silicon is higher than 1.4%, flake graphite is likely to be crystallized in the course of casting since silicon is an element serving to accelerate graphitization. Accordingly, the upper limit value of the content of silicon is set to 1.4%. The content of silicon is preferably not higher than 0.5%. The content of silicon is not lower than 0%, and this includes the case that the content of silicon is equal to 0%. In the description hereof, the content of a certain element that is equal to 0% means that the certain element is undetectable by general analyses.

The black heart malleable cast iron according to the example contains aluminum of not lower than 2.0% and not higher than 6.0%. When the content of aluminum is lower than 2.0%, this reduces the advantageous effects of enhancing the mechanical strength, the high temperature oxidation resistance and the vibration damping performance. Accordingly, the lower limit value of the content of aluminum is set to 2.0%. When the content of aluminum is higher than 6.0%, the starting temperature of decomposition of an Fe—Al composite carbide formed in the matrix exceeds 1000° C. The cast iron thus needs to be heated to high temperature for the purpose of annealing, and large-scale equipment is required. Accordingly, the upper limit value of the content of aluminum is set to 6.0%. The lower limit value of the content of aluminum is preferably 3.0%. The upper limit value is, on the other hand, preferably 5.0%.

The black heart malleable cast iron according to the example contains balance iron and inevitable impurity, in addition to the above elements. Iron is the main element of the black heart malleable cast iron. The inevitable impurity includes, for example, trace metal elements originally included in the raw material, compounds such as oxides mixed from the furnace wall in the manufacturing process and oxides produced by the reaction of the molten metal with an atmosphere gas. The total content of such inevitable impurity of not higher than 1.0% contained in the black heart malleable cast iron does not significantly change the properties of the black heart malleable cast iron. The total content of the inevitable impurity is preferably not higher than 0.5%.

In the black heart malleable cast iron according to the example, the value of a carbon equivalent CE expressed by Equation (1) given below is not lower than 3.0% and not higher than 4.2%, where C denotes the content of carbon expressed by percent by mass, Si denotes the content of silicon expressed by percent by mass and Al denotes the content of aluminum expressed by percent by mass:

$$CE=C+Si/3+Al/8 \quad (1).$$

When the value of the carbon equivalent CE is lower than 3.0%, it takes an extremely long time to decompose the Fe—Al composite carbide by annealing at a conventional annealing temperature. Accordingly, annealing for an economically practical annealing time fails to dissolve aluminum in the ferrite matrix. The value of the carbon equivalent CE of higher than 4.2%, on the other hand, fails to suppress crystallization of flake graphite in the course of casting. Accordingly, the lower limit value of the carbon equivalent CE is set to 3.0%, and the upper limit value is set to 4.2%. When the content of silicon is equal to 0%, the value of the carbon equivalent CE is calculated by setting 0 (zero) to the content Si of silicon in Equation (1).

Preferably, the total content of one or two elements selected from an element group consisting of bismuth and tellurium is higher than 0% and not higher than 0.5%. In the description hereof, the content of a certain element that is higher than 0% means that the content of the certain element is equal to or higher than a minimum detectable amount (for example, 0.01%) by general analyses. Bismuth and tellurium are elements that accelerate chilling. The black heart malleable cast iron having the total content of these elements of higher than 0% further suppresses crystallization of flake graphite in the course of casting. When the total content of bismuth and tellurium is higher than 0.5%, lump graphite is unlikely to precipitate even after annealing. Accordingly, the lower limit value of the preferable total content of bismuth and tellurium is set to be higher than 0%. The upper limit value is, on the other hand, set to 0.5%. It is more preferable to set the total content of bismuth and tellurium to be not lower than 0.01%. Adding even a small amount of these elements suppresses precipitation of flake graphite. This effect is also called an "inoculation effect."

The black heart malleable cast iron may contain manganese of higher than 0% and not higher than 0.5%. When the content of manganese is higher than 0.5%, pearlite is likely to remain in the ferrite matrix after annealing. As a result, this is likely to cause reduction of the toughness and interference with graphitization. Accordingly, the upper limit value of the content of manganese is set to 0.5%. When manganese binds with sulfur to form manganese sulfide, this does not affect the graphitization. Balancing manganese with sulfur in the molten metal accordingly reduces the effect on graphitization. When a cupola furnace is used to melt the raw material, sulfur is supplied from coke used as the fuel.

Manufacturing Method

A manufacturing method of the black heart malleable cast iron according to the example is described. The manufacturing method of the black heart malleable cast iron includes a process of preparing a molten metal by melting a raw material that contains carbon of not lower than 2.0% and not higher than 3.4%, silicon of not lower than 0% and not higher than 1.4%, aluminum of not lower than 2.0% and not higher than 6.0%, balance iron and inevitable impurity, and is blended such that value of a carbon equivalent CE expressed by Equation (1) given below is not lower than 3.0% and not higher than 4.2%, where C denotes a content of carbon expressed by percent by mass, Si denotes a content of silicon expressed by percent by mass and Al denotes a content of aluminum expressed by percent by mass. The reasons why the composition ranges of the respective elements are limited are described above, and are not described here.

$$CE=C+Si/3+Al/8 \quad (1).$$

Among the above elements, aluminum is an element likely to react with the furnace wall and form steel slug. Manganese is an element having a high vapor pressure and is likely to be evaporated and released from the surface of the molten metal. The contents of aluminum and manganese in the molten metal gradually decrease for a time duration from the start of melting the raw material to completion of casting. There is accordingly a need to blend the raw material with estimating these decreasing amounts.

The raw material used for such blend may be simple substance of carbon, silicon, aluminum and iron or may be, for example, alloys (ferroalloys) of iron and the respective elements, carbon, silicon and aluminum. Steel scrap may be used as the iron raw material. Aluminum alloy waste or the like may be used as the aluminum raw material.

When steel scrap is used as the iron raw material, carbon and silicon are included in the general steel material. In many cases, the amounts of these elements may be in the composition range specified by simply melting the steel scrap. The amount of aluminum included in the general steel material is, however, insufficient for the composition range specified, and there is a need to intentionally add aluminum to the molten metal.

A known device such as a cupola furnace or an electric furnace may be used to melt the raw material and prepare the molten metal. The content of carbon is not lower than 2.0% in the black heart malleable cast iron so that the temperature required for melting does not exceed 1400° C. Accordingly, large-scale melting equipment having the achieving temperature exceeding 1400° C. is not required.

As described above, aluminum in the molten metal is likely to react with the furnace wall and form a steel slug. Special care is accordingly needed for handling the molten metal of the example including a large amount of aluminum. More specifically, it is preferable to employ, for example, alumina that is unlikely to react with aluminum, for the material of the furnace wall. Aluminum on the surface of the molten metal is also likely to react with oxygen in the atmosphere and form an oxide. This significantly reduces flowability of the molten metal. It is accordingly preferable to perform the process of preparing the molten metal in a vacuum or in an inert gas atmosphere.

Preferably, the manufacturing method further includes a process of adding a total content of higher than 0% and not higher than 0.5% of one or two elements selected from an element group consisting of bismuth and tellurium to the molten metal, after the process of preparing the molten metal and before the process of casting a cast product. The reason for addition of bismuth and/or tellurium immediately before casting the cast product is that addition of these elements in the middle of the process of preparing the molten metal decreases the yield, due to high vapor pressures of these elements. More specifically, it is preferable to add bismuth and/or tellurium in the process of tapping the molten metal from the melting equipment into a ladle for pouring. Similar care is required for addition of manganese.

The manufacturing method of the black heart malleable cast iron includes a process of pouring the molten metal into a mold and casting a cast product. In the manufacturing method, a known mold such as a mold of molding sand or a metal mold may be used for the casting mold.

Aluminum is an element that accelerates graphitization. When the molten metal having the composition of the black heart malleable cast iron including aluminum is poured into a mold to cast a cast product, this tends to cause crystallization of flake graphite in the course of casting compared to the molten metal having the composition of the conventional black heart malleable cast iron. The molten metal having the composition range specified according to the example can be, however, cast without causing crystallization of flake graphite even when a mold of molding sand is used as the casting mold. In the description hereof, casting the cast iron without causing crystallization of flake graphite is called "chilling."

When a significant decrease of the cooling speed is expected, for example, in casting a large-size cast product or casting a thick cast product or when a molten metal used has high contents of carbon and aluminum and high graphitization potential, it is preferable to insert a cooling metal in the casting mold and accelerate cooling of the molten metal or to use a metal mold having excellent cooling performance.

In the process of casting a cast product, when the cooling speed of the molten metal from 1200° C. to 800° C. is less than 1.0° C./second, this is likely to cause crystallization of flake graphite in the course of casting and is thus unpreferable. Accordingly, it is preferable that the cooling speed of the molten metal from 1200° C. to 800° C. is not less than 1.0° C./second. The cooling speed of the molten metal from 1200° C. to 800° C. is more preferably not less than 10° C./second.

The molten metal may have a high content of aluminum and is thus likely to react with oxygen in the atmosphere or with the runner of the mold and form an aluminum oxide. Formation of the aluminum oxide is likely to reduce flowability of the molten metal. It is accordingly preferable to provide means for removing the aluminum oxide in the molten metal by forming a slug removal runner in the casting mold or providing the runner with a strainer. It is also preferable to perform the process of casting a cast product in a vacuum or in an inert gas atmosphere.

The manufacturing method of the black heart malleable cast iron includes a process of annealing the cast product to a temperature of higher than 720° C. by reheating. In the manufacturing method, a known heat treatment furnace such as a gas burner furnace or an electric furnace may be used as the device for annealing.

The process of annealing the cast product is characteristic of the manufacturing method of the black heart malleable cast iron. This process heats the cast product to a temperature of higher than 720° C. that corresponds to A1 transformation temperature to decompose cementite and precipitate flake graphite, and cools an austenite matrix to be transformed to a ferrite to provide the cast product with toughness. The process of annealing the cast product includes a first stage annealing performed first and a second stage annealing performed after the first stage annealing.

The first stage annealing is a process of decomposing cementite and the Fe—Al composite carbide in austenite to graphite in a temperature range of higher than 900° C. According to this example, the Fe—Al composite carbide is likely to be formed in the matrix in the course of casting. The Fe—Al composite carbide is decomposable at high temperature. The higher composition ratio of aluminum requires the higher temperature for decomposition. When the composition ratio of aluminum is not higher than 6.0% as specified in the example, the decomposition temperature of the Fe—Al composite carbide is not higher than 1000° C. Annealing can thus be performed at a temperature equivalent to the annealing temperature of the conventional black heart malleable cast iron without addition of aluminum. This accordingly does not require any special annealing furnace to provide high temperature.

In the first stage annealing, carbon produced by decomposition of cementite and the Fe—Al composite carbide contributes to the growth of lump graphite. Aluminum is dissolved in the austenite matrix and dissolved in the ferrite matrix after cooling.

The temperature of the first stage annealing of lower than 950° C. is not preferred, since this requires time for decomposition of cementite and growth of lump graphite and causes insufficient decomposition of the Fe—Al composite carbide. The temperature of the first stage annealing of higher than 1100° C. is not preferred, since this requires a large-scale annealing furnace and increases the energy required for the annealing process. The lower limit value of the temperature of the first stage annealing is preferably 950° C. The upper limit value is, on the other hand, preferably 1100° C. The lower limit value of the more preferable temperature range is 980° C. The upper limit value is, on the other hand, 1030° C.

The time period of the first stage annealing may be determined appropriately according to the size of the annealing furnace and the amount of the cast product to be processed. Typically, the time period of not shorter than 3.0 hours and not longer than 10 hours is preferable. In the first stage annealing, the lower value of the carbon equivalent CE requires the longer time period for decomposition of the Fe—Al composite carbide. When the value of the carbon equivalent CE is not lower than 3.0% as specified in the example, the time period required for decomposition of the Fe—Al composite carbide is not longer than 10 hours. Annealing can thus be performed for a time period equivalent to the annealing time of the conventional black heart malleable cast iron without addition of aluminum.

The second stage annealing is a process of decomposing cementite and the Fe—Al composite carbide in ferrite and/or pearlite to graphite in a lower temperature range than the temperature of the first stage annealing. It is preferable to perform the second stage annealing slowly from a second stage annealing start temperature to a second stage annealing completion temperature to accelerate growth of lump graphite and ensure transformation from austenite to ferrite. The lower limit value of the second stage annealing start temperature is preferably 720° C. The upper limit value is, on the other hand, preferably 800° C. The lower limit value of the more preferable temperature range is 740° C. The upper limit value is, on the other hand, 780° C. The second stage annealing completion temperature is preferably lower than the second stage annealing start temperature. The lower limit value of the second stage annealing completion temperature is preferably 680° C., and the upper limit value is preferably 780° C. The lower limit value of the more preferable temperature range is 710° C. The upper limit value is, on the other hand, 750° C.

The time period from the start to completion of the second stage annealing may be determined appropriately according to the size of the annealing furnace and the amount of the cast product to be processed. Typically, the time period of not shorter than 3.0 hours is preferable. The upper limit is not specified.

Mechanical Strength

The black heart malleable cast iron according to the example includes aluminum dissolved in the matrix and has the enhanced mechanical strength compared to conventional black heart malleable cast iron. For example, while the tensile strength of conventional black heart malleable cast iron is approximately 300 MPa, the tensile strength of black heart malleable cast iron containing 4.0% of aluminum is enhanced to, for example, 470 MPa. This may be attributed to the effect of dissolution of aluminum in the matrix.

A member using the black heart malleable cast iron has enhanced mechanical strength compared to a member using conventional black heart malleable cast iron, and may thus be used for applications that require high mechanical strength. This may also achieve weight reduction of the member at a fixed strength.

High Temperature Oxidation Resistance

In my black heart malleable cast iron, aluminum is dissolved in the matrix. Accordingly, even when the black heart malleable cast iron is heated to high temperature during use, formation of a layer of aluminum oxide on the surface of the black heart malleable cast iron prevents diffusion of oxygen from the surface into the inside. This accordingly enhances high temperature oxidation resistance compared to conventional black heart malleable cast iron.

In the process of annealing the cast product, a layer of aluminum oxide is also formed on the surface of the cast product during heating. This interferes with further oxidation. Accordingly, there is no need to perform annealing in a vacuum or in an inert gas atmosphere. There is also no need to use a sealing vessel or the like for the purpose of preventing the surface of the cast product from being excessively oxidized. This accordingly reduces the cost in the process of annealing the cast product.

Vibration Damping Performance

In my black heart malleable cast iron, a sufficient amount of aluminum may be dissolved in the matrix. This significantly enhances the vibration damping performance of the black heart malleable cast iron.

EXAMPLES

Example 1

A molten metal was prepared by mixing the raw materials of carbon, silicon, aluminum and iron and was subsequently poured into a casting mold provided as a mold of molding sand to obtain a cast product. The obtained cast product was heated and held at 1000° C. in the atmosphere for 5 hours, was subsequently annealed in a temperature range from 760° C. to 730° C. in 6 hours and was quenched so that a sample having the composition shown in Table 1 was obtained.

TABLE 1

| SAMPLE NAME | CARBON | SILICON | ALUMINUM | IRON AND INEVITABLE IMPURITY | CARBON EQUIVALENT |
|---|---|---|---|---|---|
| EX 1 | 2.4 | 0.01 | 5.7 | BALANCE | 3.1 |
| COMP EX 1 | 2.0 | 0.05 | 5.7 | BALANCE | 2.7 |
| COMP EX 2 | 2.3 | NOT DETECTED | 7.6 | BALANCE | 3.2 |

(UNIT: PERCENT BY MASS)

A middle portion from the obtained sample was mirror polished and etched with nital, and its metallographic structure was observed with an optical microscope. Observation of the sample of Example 1 showed the typical metallographic structure of the black heart malleable cast iron with lump graphite distributed in a ferrite matrix. This sample had a Vickers hardness of 236. Observation of a sample of Comparative Example 1, on the other hand, showed a large amount of an Fe—Al composite carbide in its metallographic structure. This may be because the Fe—Al composite carbide was not decomposed in a short time period when the sample of Comparative Example 1 was annealed at 1000° C. that was the conventional annealing temperature since the value of the carbon equivalent CE in the sample of Comparative Example 1 was lower than the lower limit of the range specified in the example.

Observation of a sample of Comparative Example 2 showed distribution of granular graphite in the grain boundary of the ferrite matrix. This sample had a Vickers hardness of 376. This may be because the Fe—Al composite carbide crystallized in the course of casting was not decomposed, but remained even after annealing since the content of aluminum in the sample of Comparative Example 2 was higher than 6.0%. The sample of Comparative Example 2 is thus estimated to have a higher Vickers hardness, but lower toughness than the sample of Example 1.

Examples 2 and 3

Each molten metal was prepared by mixing the raw materials of carbon, silicon, aluminum and iron and was subsequently poured into a metal mold to obtain a cast product. The respective obtained cast products were annealed under the sample conditions as those of Example 1 so that samples having the compositions shown in Table 2 were obtained.

TABLE 2

| SAMPLE NAME | CARBON | SILICON | ALUMINUM | IRON AND INEVITABLE IMPURITY | CARBON EQUIVALENT |
|---|---|---|---|---|---|
| EX 2 | 3.0 | 1.4 | 4.0 | BALANCE | 4.0 |
| EX 3 | 3.0 | 1.4 | 6.0 | BALANCE | 4.2 |
| COMP EX 3 | 3.0 | 1.4 | 8.0 | BALANCE | 4.5 |

(UNIT: PERCENT BY MASS)

Figure 2:
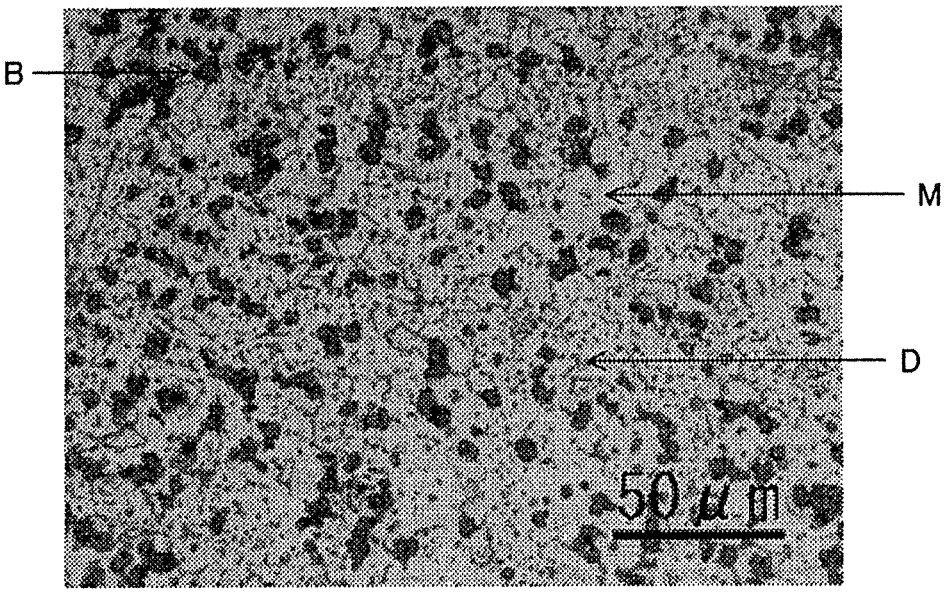
FIG. 2 is an optical micrograph of a sample of Example 3.
Figure 3:
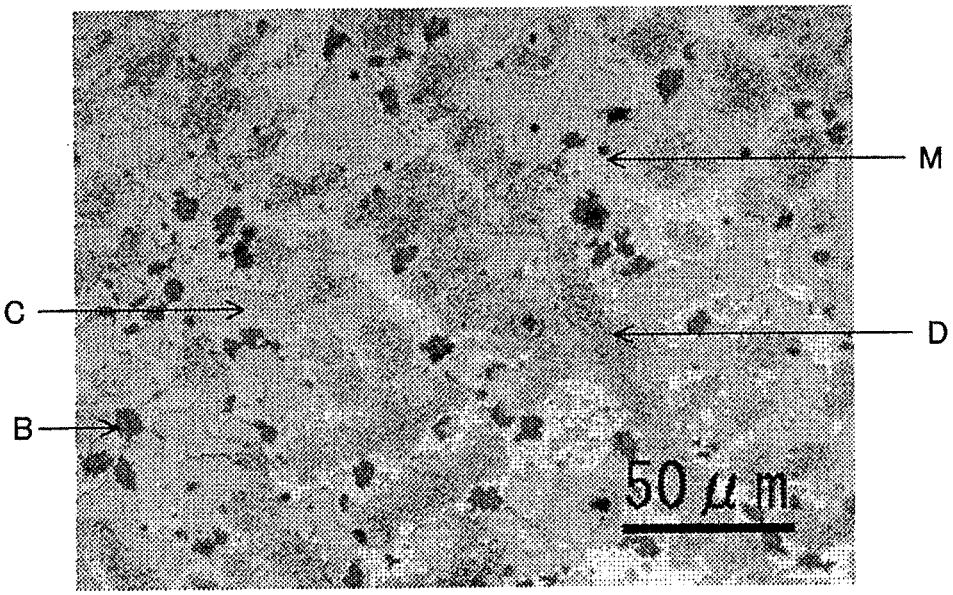
FIG. 3 is an optical micrograph of a sample of Comparative Example 3.

A middle portion from each obtained sample was mirror polished and etched with nital, and its metallographic structure was observed with an optical microscope. Optical micrographs of Example 2, Example 3 and Comparative Example 3 are respectively shown in FIGS. 1, 2 and 3. Observation of the sample of Example 2 shows the typical metallographic structure of the black heart malleable cast iron with lump graphite B distributed in a ferrite matrix M. An Fe—Al composite carbide was partly observed. The observed Fe—Al composite carbide is, however, expected to be not an Fe—Al composite carbide that is crystallized in the course of casting and is not decomposed but remains in the first stage annealing (referred to as Fe—Al composite carbide C) but an Fe—Al composite carbide that precipitates in the second stage annealing (referred to as Fe—Al composite carbide D). Observation of the sample of Example 3 showed a similar metallographic structure to that of Example 2 with the smaller grain size of the ferrite matrix M and the smaller size of the lump graphite B than those of Example 2.

The metallographic structure of Comparative Example 3 had some distribution of the equivalent size of the lump graphite B to that of Example 3, but had an extremely smaller amount of the lump graphite B than that of the metallographic structure of Example 3. A large amount of the Fe—Al composite carbide C and the Fe—Al composite carbide D were present in the matrix M. It is accordingly expected that the matrix was mainly composed of the Fe—Al composite carbide.

Tensile test samples were respectively obtained from the sample of Example 2 and the sample of Example 3. Each tensile test sample was processed to the overall length of 25 mm, the outer diameter of a grip of 6.0 mm ϕ, the outer diameter of a central part of 3.57 mmϕ and the length of the central part of 15 mm. Each sample was set in a universal tester (model number: RH-50) manufactured by Shimadzu Corporation for measurement of the tensile strength and the elongation. The sample of Comparative Example 3 was too hard to produce a tensile test sample. The sample of Example 2 had a tensile strength of 468 MPa and an elongation of 11.3%. The sample of Example 3 had a tensile strength of 623 MPa and an elongation of 4.1%.

The conventional black heart malleable cast iron that does not contain aluminum has a tensile strength of approximately 300 MPa and an elongation of approximately 10%. The samples of Example 2 and Example 3 containing aluminum have the enhanced tensile strengths. This may be attributed to solution hardening by dissolving aluminum in the matrix. The decrease in elongation of Example 3 may be attributed to precipitation of the Fe—Al composite carbide D in the second stage annealing.

A test sample of 12 mm in vertical length, 10 mm in lateral length and 2 mm in thickness was obtained from each of the samples of Example 2 and Example 3, was kept at 800° C. in the atmosphere for 6 hours after surface polishing, further kept at 900° C. for 3 hours and then cooled down. For the purpose of comparison, a test sample was also obtained from a sample of the conventional black heart malleable cast iron and subjected to the same treatment. The surfaces of the respective test samples after the treatment were observed. The result of observation shows that generation of the oxidation scale on the surface was significantly reduced in the respective test samples of Examples compared to that in the test sample of the conventional black heart malleable cast iron.

Examples 4 and 5

Each molten metal was prepared by mixing the raw materials of carbon, silicon, aluminum and iron and subsequently poured into a metal mold to obtain a cast product. The respective obtained cast products were heated and held at 1050° C. in the atmosphere for 10 hours, subsequently annealed in a temperature range from 760° C. to 730° C. in 10 hours and quenched so that samples having the compositions shown in Table 3 were obtained.

TABLE 3

| SAMPLE NAME | CARBON | SILICON | ALUMINUM | IRON AND INEVITABLE IMPURITY | CARBON EQUIVALENT |
|---|---|---|---|---|---|
| EX 4 | 3.0 | 0.8 | 4.0 | BALANCE | 3.8 |
| EX 5 | 3.0 | 0.8 | 6.0 | BALANCE | 4.0 |
| COMP EX 4 | 3.0 | 0.8 | 8.0 | BALANCE | 4.3 |

(UNIT: PERCENT BY MASS)

Figure 4:
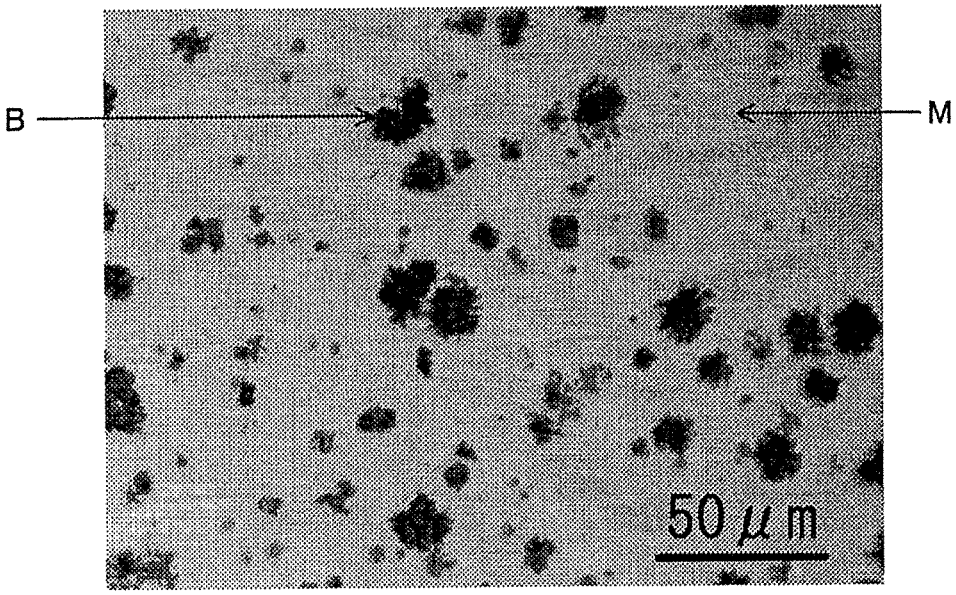
FIG. 4 is an optical micrograph of a sample of Example 4.
Figure 5:
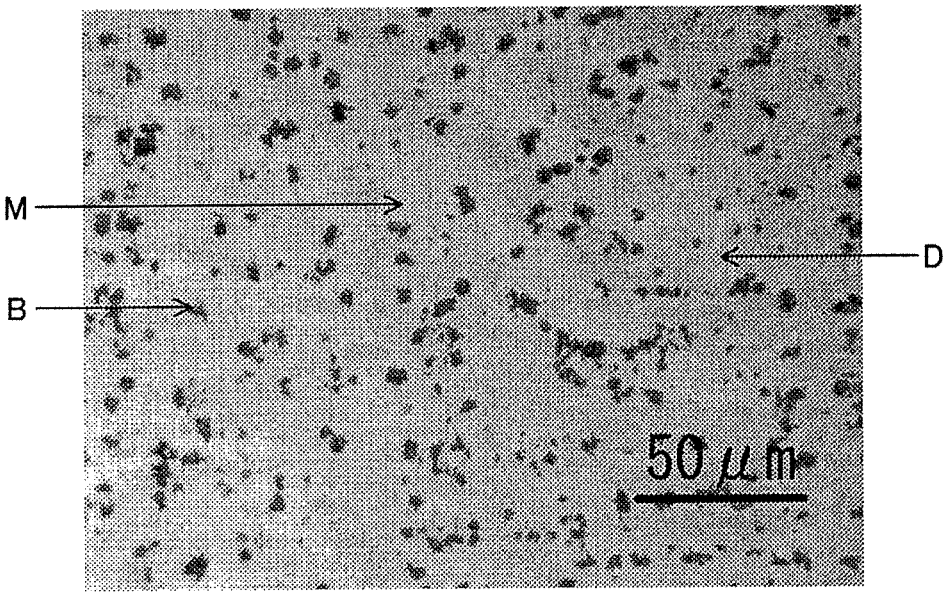
FIG. 5 is an optical micrograph of a sample of Example 5.
Figure 6:
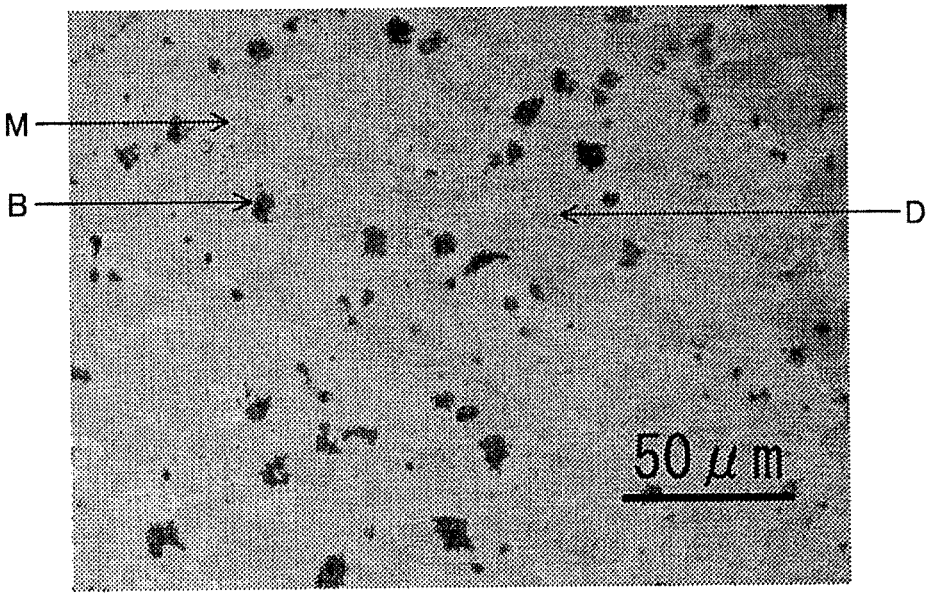
FIG. 6 is an optical micrograph of a sample of Comparative Example 4.

A middle portion from each obtained sample was mirror polished and etched with nital, and its metallographic structure was observed with an optical microscope. Optical micrographs of Example 4, Example 5 and Comparative Example 4 are respectively shown in FIGS. 4, 5 and 6. Observation of the sample of Example 4 shows the typical metallographic structure of the black heart malleable cast iron with lump graphite B distributed in a ferrite matrix M.

Observation of the sample of Example 5 showed a similar metallographic structure to that of Example 4 with the smaller grain size of the ferrite matrix M and the smaller size of the lump graphite B than those of Example 4. The sample of Example 5 employed the longer first stage annealing time and the longer second stage annealing time compared to the sample of Example 2. Accordingly, the Fe—Al composite carbide C crystallized in the course of casting was decomposed and hardly remained in the sample of Example 5. The Fe—Al composite carbide D precipitating in the annealing process was, on the other hand, slightly observed.

The sample of Comparative Example 4 employed the longer first stage annealing time and the longer second stage annealing time compared to the sample of Comparative Example 3. In the metallographic structure of Comparative Example 4, most of the Fe—Al composite carbide C crystallized in the course of casting was decomposed, while the Fe—Al composite carbide D precipitated in the second stage annealing. Like the metallographic structure of Comparative Example 3, the metallographic structure of Comparative Example 4 has a low ratio of the ferrite matrix M and is accordingly expected to have lower toughness and lower processability compared to those of the Examples.

As shown by the Examples above, my black heart malleable cast iron has the similar metallographic structure to that of the conventional black heart malleable cast iron without addition of aluminum and has the better mechanical strength, the better high temperature oxidation resistance and the better vibration damping performance compared to the conventional black heart malleable cast iron without addition of aluminum.

As described above, setting the contents of carbon, aluminum and silicon and the value of the carbon equivalent CE in the above ranges suppresses precipitation of flake graphite in the course of casting and allows for formation of lump graphite. Even annealing at the same temperature as the conventional annealing temperature enables the Fe—Al composite carbide to be decomposed in a short time period.

Aluminum may be dissolved in the ferrite matrix. This enhances mechanical strength and vibration damping performance of the black heart malleable cast iron compared to conventional black heart malleable cast iron.

Even when the black heart malleable cast iron of the example is heated to high temperature during use, formation of a layer of aluminum oxide on the surface of the black heart malleable cast iron prevents diffusion of oxygen from the surface into the inside. This accordingly enhances the high temperature oxidation resistance of the black heart malleable cast iron, compared to conventional black heart malleable cast iron.

The example describes the aspect of adding aluminum to the black heart malleable cast iron. This disclosure is, however, not limited to this aspect, but may be applicable to an aspect by adding aluminum to a white heart malleable cast iron or to an aspect by adding aluminum to a pearlite malleable cast iron.

The invention claimed is:

1. A black heart malleable cast iron comprising lump graphite distributed in a ferrite matrix, and a composition comprising:

carbon of not lower than 2.0% and not higher than 3.4%;

silicon of not lower than 0% and not higher than 1.4%;

aluminum of not lower than 2.0% and not higher than 6.0%, which are all expressed by percent by mass; and balance iron and inevitable impurities, wherein the black heart malleable cast iron contains a concentration of aluminum dissolved in the ferrite matrix sufficient to improve a high temperature oxidation resistance of the black heart malleable cast iron compared to conventional black heart malleable cast iron, and a value of a carbon equivalent CE expressed by Equation (1) is not lower than 3.0% and not higher than 4.2%, where C denotes a content of the carbon expressed by percent by mass, Si denotes a content of the silicon expressed by percent by mass and Al denotes a content of the aluminum expressed by percent by mass:

$$CE=C+Si/3+Al/8 \quad (1).$$

2. The black heart malleable cast iron according to claim 1, wherein the content of the silicon is not lower than 0% and not higher than 0.5%.

3. The black heart malleable cast iron according to claim 1, wherein the content of the aluminum is not lower than 4.0% and not higher than 6.0%.

4. The black heart malleable cast iron according to claim 1, wherein the content of silicon is not lower than 0% and not higher than 0.8%.

5. A method of manufacturing a black heart malleable cast iron comprising:

preparing a molten metal by melting a raw material comprising carbon of not lower than 2.0% and not higher than 3.4%, silicon of not lower than 0% and not higher than 1.4%, aluminum of not lower than 2.0% and not higher than 6.0%, which are all expressed by percent by mass, and balance iron and inevitable impurities and that is blended such that a value of a carbon equivalent CE expressed by Equation (1) is not lower than 3.0% and not higher than 4.2%, where C denotes a content of the carbon expressed by percent by mass, Si denotes a content of the silicon expressed by percent by mass and Al denotes a content of the aluminum expressed by percent by mass;

pouring the molten metal into a mold to cast a chilled cast product; and reheating the cast product to a temperature of higher than 720° C. and annealing:

$$CE=C+Si/3+Al/8 \quad (1)$$

thereby producing the black heart malleable cast iron of claim 1.

6. The method according to claim 5, wherein the content of the silicon is not lower than 0% and not higher than 0.5%.

7. The method according to claim 5, wherein the content of the aluminum is not lower than 4.0% and not higher than 6.0%.

* * * * *